US010439367B2

(12) United States Patent
Tamura et al.

(10) Patent No.: US 10,439,367 B2
(45) Date of Patent: Oct. 8, 2019

(54) IGNITION PLUG FOR AN INTERNAL COMBUSTION ENGINE AND METHOD FOR MANUFACTURING THE SAME

(71) Applicant: DENSO CORPORATION, Kariya, Aichi-pref. (JP)

(72) Inventors: Masayuki Tamura, Kariya (JP); Nobuo Abe, Kariya (JP); Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/088,971

(22) PCT Filed: Mar. 24, 2017

(86) PCT No.: PCT/JP2017/012156
§ 371 (c)(1),
(2) Date: Sep. 27, 2018

(87) PCT Pub. No.: WO2017/170273
PCT Pub. Date: Oct. 5, 2017

(65) Prior Publication Data

US 2019/0214795 A1 Jul. 11, 2019

(30) Foreign Application Priority Data

Mar. 29, 2016 (JP) ..... 2016-066269

(51) Int. Cl.
*H01T 13/34* (2006.01)
*H01T 13/52* (2006.01)
(Continued)

(52) U.S. Cl.
CPC ..... *H01T 13/39* (2013.01); *H01T 13/08* (2013.01); *H01T 13/32* (2013.01); *H01T 21/02* (2013.01)

(58) Field of Classification Search
CPC ..... H01T 13/34; H01T 13/52; H01T 13/467
See application file for complete search history.

(56) References Cited

U.S. PATENT DOCUMENTS 8,760,045 B2 * 6/2014 Kawashima ..... B23K 9/0026 313/142
9,929,542 B2 * 3/2018 Araya ..... H01T 13/32
(Continued)

FOREIGN PATENT DOCUMENTS

JP 5545166 7/2014

*Primary Examiner* — Tracie Y Green
(74) *Attorney, Agent, or Firm* — Nixon & Vanderhye P.C.

(57) ABSTRACT

An ignition plug for an internal combustion engine includes an electrode protrusion that protrudes from an electrode base material of a ground electrode toward a discharge gap. The electrode protrusion has a base part that is integrated with the electrode base material and a cover part that is joined to the base part and faces the discharge gap. The base part has an end surface facing a protrusion direction of the base part and a side peripheral surface. An outer edge of the end surface has a curved surface. The cover part is formed from a precious metal or a precious metal alloy having a lower linear expansion coefficient than that of a material for forming the base part and covers at least a part of the side peripheral surface and the end surface of the base part. While the ignition plug is attached to an internal combustion engine and the electrode protrusion is heated and then cooled, a projection is formed on an outer surface of a portion covering the side peripheral surface of the base part.

8 Claims, 9 Drawing Sheets

(51) Int. Cl.

| | |
|---|---|
| ***H01T 13/39*** | (2006.01) |
| ***H01T 21/02*** | (2006.01) |
| ***H01T 13/32*** | (2006.01) |
| ***H01T 13/08*** | (2006.01) |

(56) References Cited

U.S. PATENT DOCUMENTS

| | | | | |
|---|---|---|---|---|
| 2010/0213812 | A1 | 8/2010 | Kawashima et al. | |
| 2010/0289397 | A1 | 11/2010 | Hanashi et al. | |
| 2011/0210659 | A1 | 9/2011 | Suzuki et al. | |
| 2011/0316408 | A1* | 12/2011 | Suzuki ..... | H01T 13/20<br>313/141 |
| 2012/0190266 | A1 | 7/2012 | Hanashi et al. | |

* cited by examiner

IGNITION PLUG FOR AN INTERNAL COMBUSTION ENGINE AND METHOD FOR MANUFACTURING THE SAME

CROSS-REFERENCE TO RELATED APPLICATION

This application is the U.S. national phase of International Application No. PCT/JP2017/012156 filed on Mar. 24, 2017 which designated the U.S. and claims priority to Japanese Patent Application No. 2016-66269 filed on Mar. 29, 2016, the entire contents of each of which are incorporated herein by reference.

TECHNICAL FIELD

The present invention relates to an ignition plug for an internal combustion engine and a method for manufacturing the same.

BACKGROUND ART

Conventionally, internal combustion engines such as automobile engines include an ignition device with an ignition plug that makes an ignition discharge to ignite a mixed gas of fuel and air. In recent years, internal combustion engines have been improved in fuel efficiency by lean combustion, and there has been a demand for enhancing ignition performance in lean combustion. For example, PTL 1 discloses an ignition plug in which a needle-like chip is formed on a ground electrode to improve ignition performance. In the ignition plug, a base material for the chip is formed from an inexpensive metal and end and side surfaces of the chip are partially covered with a precious metal to suppress the needle-like chip from wearing caused by a spark discharge and reduce the cost of the needle-like chip.

CITATION LIST

Patent Literature

[PTL 1] JP 5545166 B

SUMMARY OF THE INVENTION

According to the configuration disclosed in PTL 1, the chip is needle-like and thus susceptible to temperature changes in a cylinder, and the chip itself also undergoes remarkable temperature changes. The chip is formed from a precious metal and an inexpensive base metal different in linear expansion coefficient, and large thermal stress is produced in the chip due to temperature changes in the chip itself. The thermal stress is likely to concentrate on corners between the end and side surfaces of the base material at the joints between the precious metal and the base material, which may cause cracks in the precious metal joined to the corners. In the event of such cracks occurring, the cracked portion suffers high-temperature oxidation in a high-temperature corrosion atmosphere of the cylinder, and the precious metal may become partially peeled or come off to shorten the lifetime of the ignition plug.

In addition, since a lean-combustion engine has fast airflow in a cylinder, a spark discharge generated in a discharge gap is likely to flow together with the airflow. In the foregoing configuration with the needle-like chip, the spark discharge may move to the base side of the chip by the fast airflow to lengthen excessively the discharge path and raise a self-sustaining discharge voltage. In such a case, the spark discharge may be blown off to deteriorate ignition performance.

An object of the present disclosure is to provide an ignition plug for an internal combustion engine that achieves a longer lifetime and improved ignition performance, and a method for manufacturing the same.

Solution to Problem

An aspect of the present disclosure is an ignition plug for an internal combustion engine including: a center electrode; a ground electrode that is disposed opposing the center electrode to form a discharge gap between the center electrode and the ground electrode; and an electrode protrusion that protrudes from an electrode base material of the ground electrode toward the discharge gap. The electrode protrusion has a base part that is integrated with the electrode base material and a cover part that is joined to the base part and faces the discharge gap. The base part has an end surface facing a protrusion direction of the base part and a side peripheral surface that leads from an outer edge of the end surface to the electrode base material, and the outer edge of the end surface forms a curved surface. The cover part is formed from a precious metal or a precious metal alloy lower in linear expansion coefficient than a material for forming the base part and covers at least a part of the side peripheral surface and the end surface. When the ignition plug is attached to an internal combustion engine and the electrode protrusion is heated and then cooled in a cylinder, a projection is formed on an outer surface of a portion of the cover part covering the side peripheral surface of the base part.

Another aspect of the present disclosure is a method for manufacturing the ignition plug for the internal combustion engine. The method includes: a joint step of joining a cover part raw material formed from a precious metal or a precious metal alloy having a lower linear expansion coefficient than that of a material for forming the electrode base material to the electrode base material by resistance welding; a preparation step of setting a first jig with a concave portion along the cover part raw material joined to the electrode base material to form a space between the cover part raw material and the concave portion; and an extrusion step of pressing a second jig with a convex portion larger than an opening in the concave portion against the concave portion at a portion of the electrode base material on the side opposite to a raw material joint part joined to the cover part raw material to extrude the raw material joint part into the space and form a convex base part and forming a cover part in which the cover part raw material covers at least a part of a side peripheral surface and an end surface facing the protrusion direction of the base part, thereby forming the electrode protrusion.

Advantageous Effects of the Invention

In the ignition plug for the internal combustion engine, a portion of the electrode protrusion has the cover part formed from a precious metal or a precious metal alloy facing the discharge gap. Therefore, the electrode protrusion has less wear due to a spark discharge to achieve a longer lifetime of the ignition plug. Further, the material for forming the base part of the electrode protrusion can be less expensive than that for the cover part. This reduces manufacturing costs as compared to a case of forming the entire electrode protrusion from the material for forming the cover part.

In addition, the precious metal or the precious metal alloy for forming the cover part is lower in linear expansion coefficient than the material for forming the base part, and thus there occurs a difference in linear expansion coefficient between the two materials. However, the outer edge of the end surface of the base part as seen in the protrusion direction has a curved surface that makes it less likely to form corners in the joint portion between the base part and the cover part covering the base part. This suppresses excessive concentration of thermal stress from occurring resulting from the difference in linear expansion coefficient. As a result, cracks due to thermal stress is suppressed from occurring in the joint portion between the base part and the cover part covering the base part to achieve a longer lifetime of the ignition plug from this viewpoint as well.

Further, when the ignition plug for the internal combustion engine is attached to the internal combustion engine, and heated and cooled in the cylinder, the projection is formed on the portion of the cover part covering the side peripheral surface of the base part. Accordingly, in a lean-combustion engine with a fast airflow in a cylinder, even when a spark discharge generated in the discharge gap is about to move to the base part side of the chip by the high-velocity airflow, the spark discharge is likely to concentrate on the protrusion of the portion that covers the side peripheral surface of the base part, which prevents the discharge path from becoming lengthen excessively. This suppresses the spark discharge from being blown-off. As a result, the ignition performance is improved. The protrusion is formed resulting from the difference in linear expansion coefficient between the material for forming the base part and the material for forming the cover part.

According to the method for manufacturing the ignition plug for the internal combustion engine, the cover part raw material is joined to the electrode base material by resistance welding in the joint step. Accordingly, the cover part raw material and the electrode base material do not have an intermediate layer therebetween that would be formed by melt-mixing the two materials in a case of using laser welding or electronic beam welding, but has an interface therebetween. Therefore, when the ignition plug is attached to an internal combustion engine and heated and cooled in the cylinder, the ignition plug for an internal combustion engine has the projection formed in a reliable manner in the presence of the difference in linear expansion coefficient between the materials for forming the two parts. This facilitates the manufacture of the ignition plug for an internal combustion engine.

As described above, according to the present disclosure, it is possible to provide an ignition plug for an internal combustion engine that achieves a longer lifetime and improved ignition performance, and a method for manufacturing the same.

A side of an ignition plug for an internal combustion engine inserted into a combustion chamber is designated as a leading-end side, and an opposite side thereof is designated as a base-end side. In addition, hereinafter, a plug axial direction refers to an axial direction of the ignition plug, a plug radial direction refers to a radial direction of the ignition plug, and a plug circumferential direction refers to a circumferential direction of the ignition plug.

BRIEF DESCRIPTION OF THE DRAWINGS

The foregoing and other objects, features, and advantages of the present disclosure will be more clarified by the following detailed description with reference to the attached drawings.

DESCRIPTION OF EMBODIMENTS

First Embodiment

An embodiment of an ignition plug for an internal combustion engine of the present disclosure will be described with reference to FIGS. 1 to 7.

Figure 1:
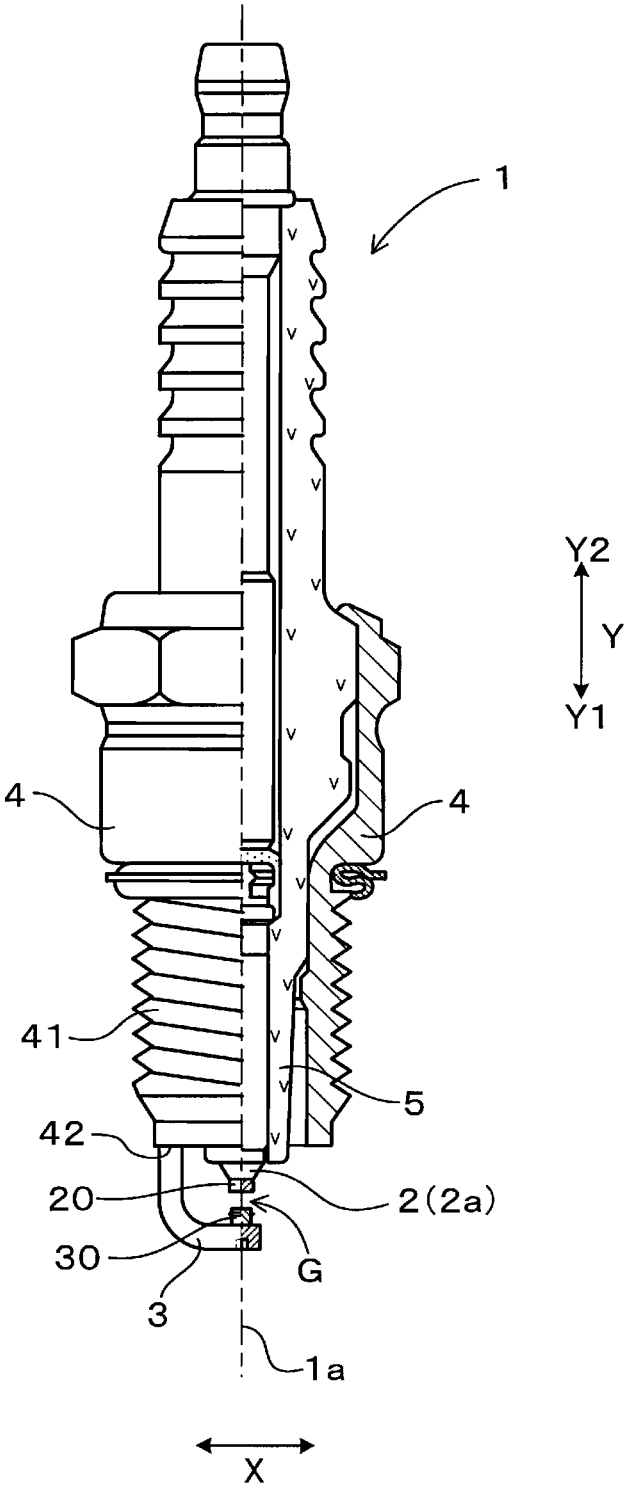
FIG. 1 is a partially cross-sectional front view of an ignition plug in a first embodiment.

An ignition plug 1 for an internal combustion engine in the embodiment (hereinafter, also called "ignition plug 1") includes a center electrode 2 and a ground electrode 3 as illustrated in FIG. 1. The ground electrode 3 is opposed to the center electrode 2 to form a discharge gap G between the ground electrode 3 and the center electrode 2. The ground electrode 3 has an electrode protrusion 30 that protrudes from an electrode base material 3*a* toward the discharge gap G.

Figure 2:
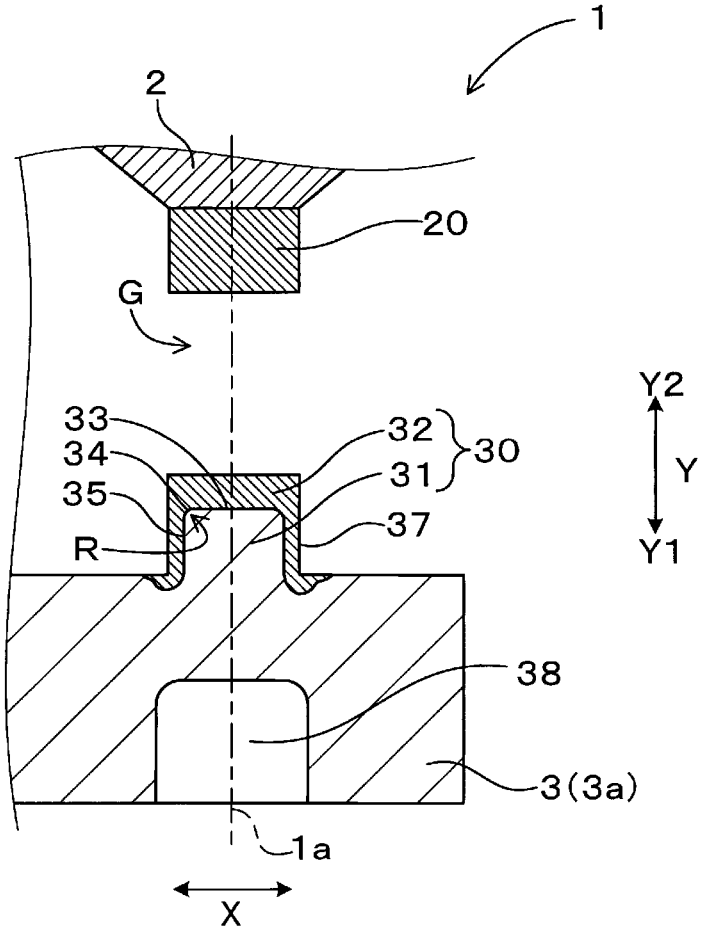
FIG. 2 is a partially enlarged cross-sectional view of a discharge gap and its vicinity in the first embodiment.

As illustrated in FIG. 2, the electrode protrusion 30 has a base part 31 and a cover part 32. The base part 31 is integrated with the electrode base material 3*a*.

The cover part 32 is joined to the base part 31 and faces the discharge gap G.

The base part 31 has an end surface 33 facing a protruding direction Y2 and a side peripheral surface 35 that leads from an outer edge 34 of the end surface 33 to the electrode base material 3*a*. The outer edge 34 of the end surface 33 forms a curved surface.

The cover part 32 is formed from a precious metal or a precious metal alloy having a lower linear expansion coefficient than that of the material for forming the base part 31 and covers at least a part of the side peripheral surface 35 and the end surface 33.

Figure 3:
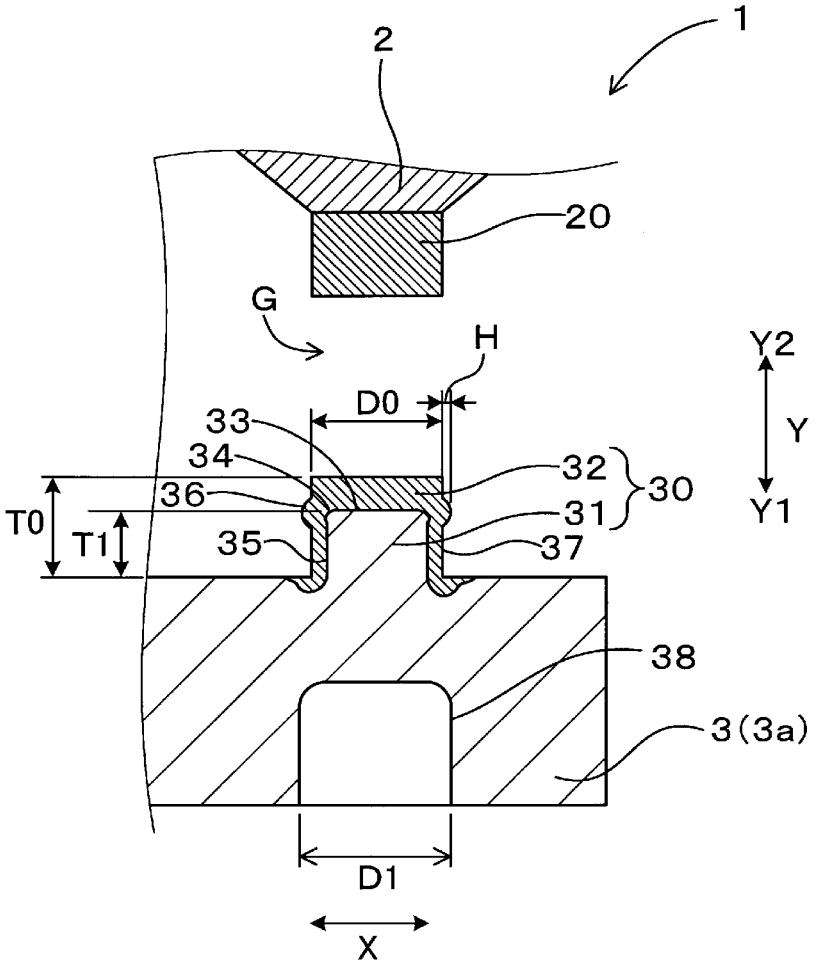
FIG. 3 is a partially enlarged cross-sectional view of the discharge gap and its vicinity after being heated and cooled in the first embodiment.

As illustrated in FIG. 3, the ignition plug 1 for an internal combustion engine is configured such that, while the ignition plug 1 is attached to an internal combustion engine not illustrated and the electrode protrusion 30 is heated and then cooled in a cylinder, a projection 36 is formed on an outer surface 37 of a portion of the cover part 32 covering the side peripheral surface 35 of the base part 31.

The ignition plug 1 in the embodiment will be described below in detail.

As illustrated in FIG. 1, the ignition plug 1 has a cylindrical housing 4 that extends in the plug axial direction Y. An outer peripheral surface of the housing 4 has an attachment threaded portion 41 for screwing into an internal combustion engine (not illustrated). The ignition plug 1 is attached to the internal combustion engine by screwing the attachment threaded portion 41 into the internal combustion engine such that the discharge gap G is exposed to a combustion chamber (not illustrated) in the internal combustion engine.

The housing 4 has a cylindrical insulator 5 therein, and the insulator 5 contains a bar-like center electrode 2 therein. The center electrode 2 has a leading-end portion 2*a* as an end on a leading-end side Y1 in the plug axial direction Y that protrudes from the insulator 5 to the leading-end side Y1 in the plug axial direction Y. The leading-end portion 2*a* is provided with an electrode chip 20. In the embodiment, the electrode chip 20 has a needle-like shape that protrudes to the leading-end side Y1 in the plug axial direction Y.

As illustrated in FIG. 1, the ground electrode 3 is extended from a leading-end surface 42 of the housing 40 as an end on the leading-end side Y1 in the plug axial direction Y to the leading-end side Y1 and is bent to form the discharge gap G with a predetermined space left from the leading-end portion 2*a* of the center electrode 2 in the plug axial direction Y. The ground electrode 3 has the electrode protrusion 30 that protrudes from the electrode base material 3*a* toward the discharge gap G on a plug central axis 1*a*.

As illustrated in FIG. 2, the electrode protrusion 30 has the base part 31 and the cover part 32. The base part 31 is integrated with the electrode base material 3*a* of the ground electrode 3. The base part 31 is substantially columnar in shape and protrudes toward the discharge gap G. That is, the base part 31 protrudes toward a base-end side Y2 in the plug axial direction Y. The end surface 33 of the base part 31 in the protrusion direction Y2 is planar except for its outer edge 34. The base part 31 is formed from the same material as that for forming the electrode base material 3*a* and constitutes a part of the electrode protrusion 30.

As illustrated in FIG. 2, the outer edge 34 of the end surface 33 has a curved surface that leads to the side peripheral surface 35 substantially parallel to the protrusion direction Y2. A cross section of the outer edge 34 including the plug central axis 1*a* preferably has a curvature radius R of 0.1 mm≤R, more preferably 0.1 mm≤R≤0.45 mm.

Figure 5:
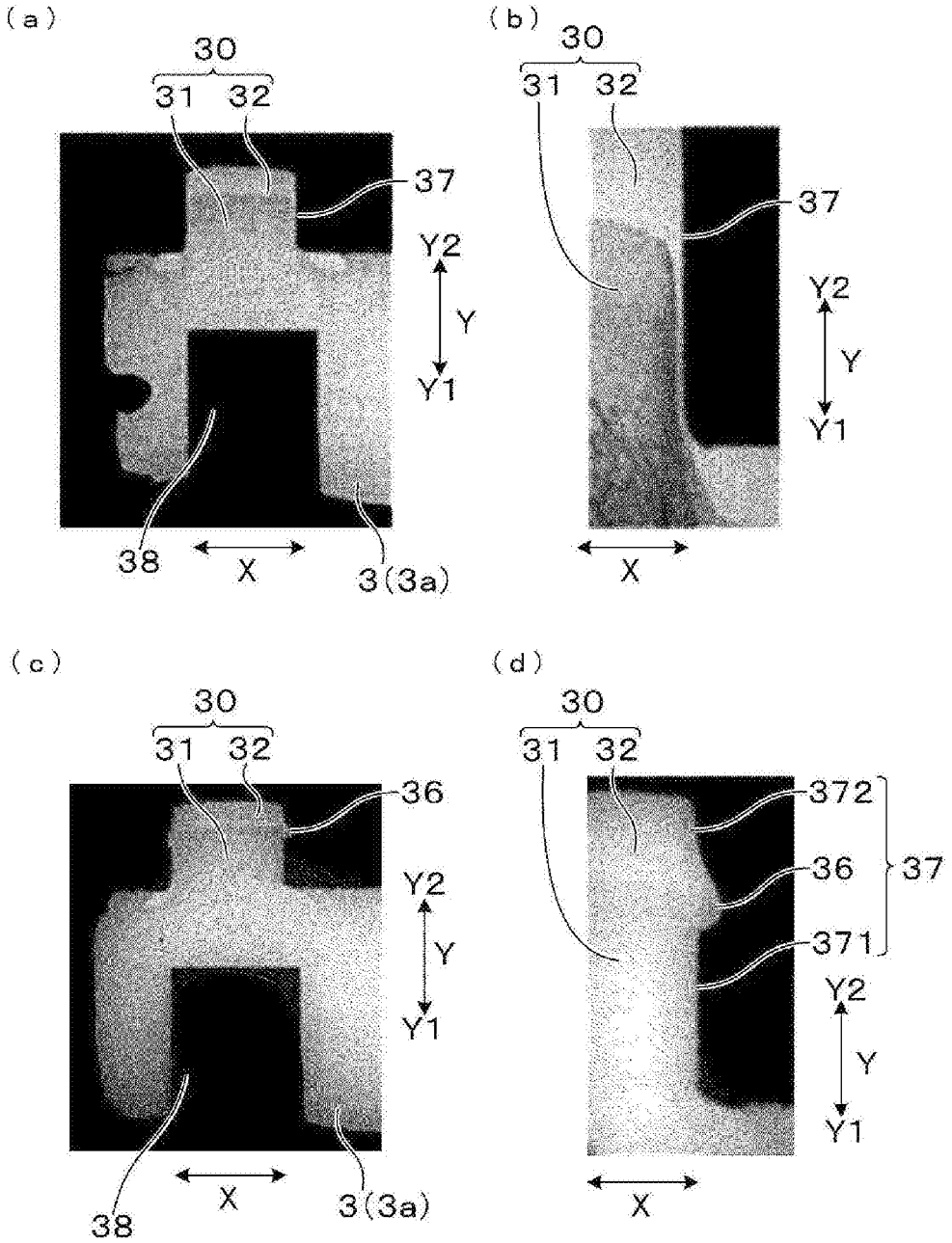
FIG. 5 is a diagram describing the process of formation of the projection in the first embodiment.

As illustrated in FIG. 2, the cover part 32 covers the base part 31. In the present embodiment, the cover part 32 covers the end surface 33, the outer edge 34, and the side peripheral surface 35. Accordingly, the end surface 33, the outer edge 34, and the side peripheral surface 35 constitute an interface between the base part 31 and the cover part 32. For the convenience of description, FIG. 2 illustrates the cover part 32 covering the side peripheral surface 35 as thicker than the actual one. In the present embodiment, the cover part 32 covering the side peripheral surface 35 is actually thinner as illustrated in FIG. 5(*b*). FIG. 2 illustrates the thicker cover part 32 for the sake of convenience as described above, however, the cover part 32 covering the side peripheral surface 35 may be really made thicker as illustrated in FIG. 2.

The cover part 32 is formed from a precious metal or a precious metal alloy having the lower linear expansion coefficient than that of the material for forming the base part 31. In the present embodiment, the material for forming the base part 31 may be, for example, nickel (Ni) with a linear expansion coefficient ($10^{-6}$/K) of 13.3, copper (Cu) with a linear expansion coefficient ($10^{-6}$/K) of 16.5, iron (Fe) with a linear expansion coefficient ($10^{-6}$/K) of 11.8, or a nickel alloy, a copper alloy, or an iron alloy with a linear expansion coefficient ($10^{-6}$/K) of about 10 to 18. In the present embodiment, Inconel 600 ("Inconel" is a registered trademark) of Special Metals Corporation, which is a nickel alloy with a linear expansion coefficient ($10^{-6}$/K) of 12.8, is used as the material for forming the base part 31.

The material for forming the cover part 32 may be a precious metal or a precious metal alloy such as platinum (Pt) with a linear expansion coefficient ($10^{-6}$/K) of 8.9, iridium (Ir) with a linear expansion coefficient ($10^{-6}$/K) of 6.5, or a platinum alloy, an iridium alloy, or a platinum-iridium alloy with a linear expansion coefficient ($10^{-6}$/K) of less than 10. In the present embodiment, platinum is used as material for forming the cover part 32. A difference $\alpha$ in linear expansion coefficient between the material for forming the cover part 32 and the material for forming the base part 31 preferably satisfies $3.3\times10^{-6}/K \leq \alpha \leq 4.5\times10^{-6}/K$, and is $3.9\times10^{-6}$/K in the present embodiment.

Then, as illustrated in FIG. 3, when the ignition plug 1 in the present embodiment is attached to the internal combustion engine not illustrated and heated and cooled in the cylinder, the projection 36 is formed on the outer surface 37 of a portion of the cover part 32 covering the side peripheral surface 35 of the base part 31. In the present embodiment, the projection 36 is formed in an annular shape on the entire outer surface 37 of the cover part 32 in the plug peripheral direction.

Figure 4:
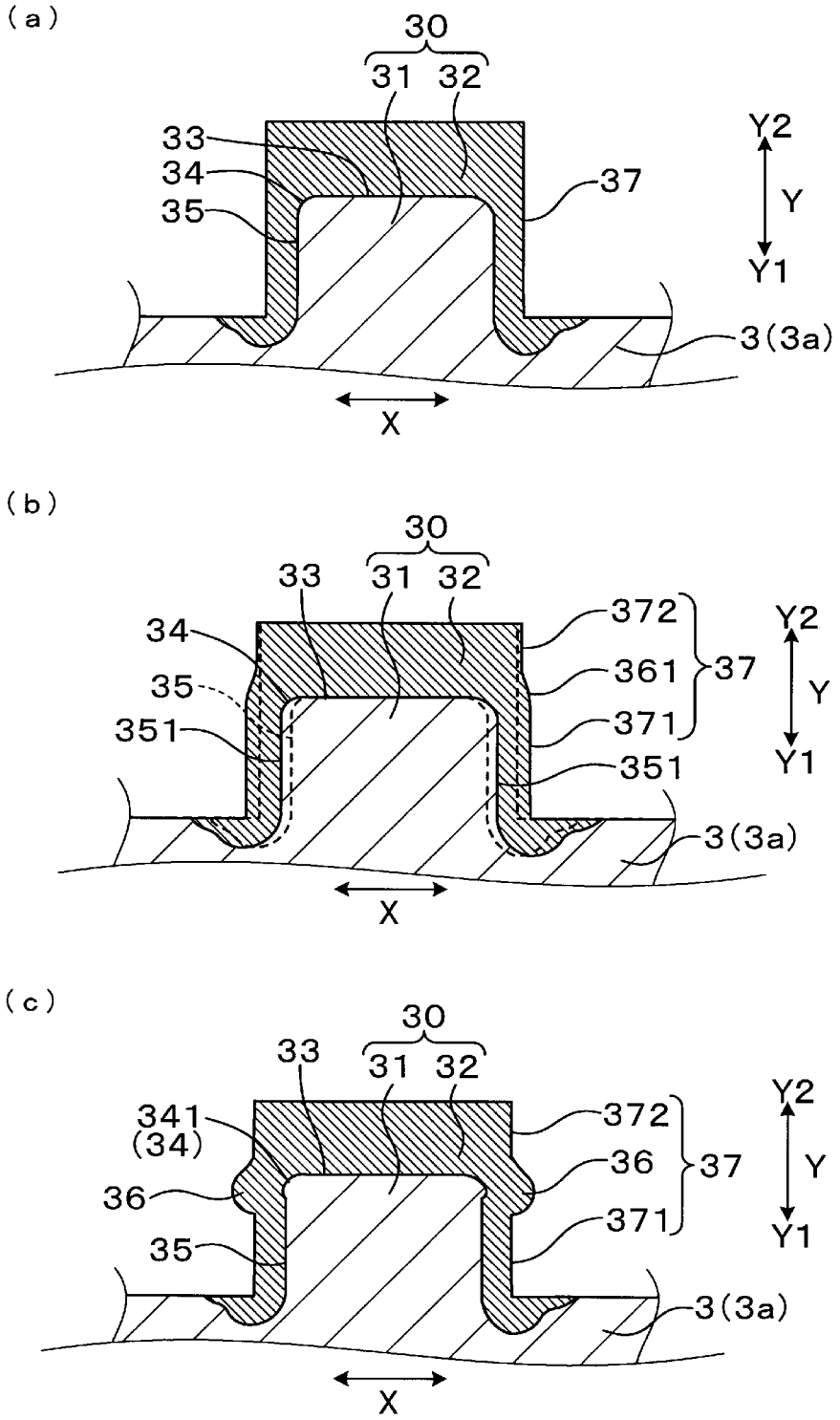
FIG. 4 is a partially enlarged cross-sectional view of the discharge gap and its vicinity for describing the process of formation of a projection in the first embodiment.

The process of formation of the projection 36 is as described below. First, as illustrated in FIGS. 4(*a*), 5(*a*), and 5(*b*), the outer surface 37 of the cover part 32 does not have yet the projection 36 in the initial state. Then, the ignition plug 1 is attached to the internal combustion engine not illustrated, the electrode protrusion 30 is heated at a high temperature in the cylinder to expand the base part 31 and the cover part 32. The expansion takes place by heating at about 800□, for example.

The cover part 32 is formed from a material having the lower linear expansion coefficient than that of the material for forming the base part 31, and thus the cover part 32 has a smaller amount of heat expansion than the base part 31. Accordingly, as illustrated in FIG. 4(*b*), the outer surface 37 of the cover part 32 has a first outer surface 371 positioned closer to the leading-end side Y1 in the plug axial direction Y than the end surface 33 of the base part 31. The first outer surface 371 is pressed outward in the plug radial direction X by a side peripheral surface 351 of the base part 31 in the expanded state, and is more extended in the plug radial direction X than a second outer surface 372 positioned closer to the base-end side Y2 of the plug axial direction Y than the end surface 33 of the base part 31. As a result, the cover part 32 plastically deforms to form a step portion 361 between the first outer surface 371 and the second outer surface 372. The broken lines in FIG. 4(*b*) indicate the shape of the electrode protrusion 30 before heat expansion.

After that, when the temperature of the cylinder is lowered to cool the electrode protrusion 30, the expanded base part 31 and cover part 32 start to contract and return to the initial state. However, the cover part 32 can contract but cannot return to the initial state because of the projection 361 formed by plastic deformation of the cover part 32, which forms the projection 36 as illustrated in FIGS. 4(*c*), 5(*c*), and 5(*d*). In addition, outward force is exerted on the outer edge 34 of the base part 31 in the plug radial direction X due to the formation of the projection 36 at the time of contraction. Accordingly, the outer edge 341 slightly swells outward in the plug radial direction as illustrated in FIG. 4(*c*). The curvature radius R of the outer edge 34 herein refers to that in the initial state illustrated in FIG. 4(*a*).

As illustrated in FIG. 3, in the present embodiment, the electrode protrusion 30 is substantially columnar in shape with a height T0 of 0.8 mm and a diameter D0 of 0.7 mm. The base part 31 has a height T1 of 0.5 mm that is substantially identical to the height of a peak in the projection 36 in the protrusion direction X. A concave portion 38 is substantially cylindrical in shape with an opening diameter D1 of 0.8 mm.

As illustrated in FIG. 3, in the present embodiment, the height H (mm) of the projection 36, that is, an amount of protrusion in a direction orthogonal to the plug axial direction Y preferably satisfies $H \leq -0.067R+0.227$ where the curvature radius of the outer edge 34 is designated as R (mm). In the present embodiment, H is 0.2 mm.

Figure 6:
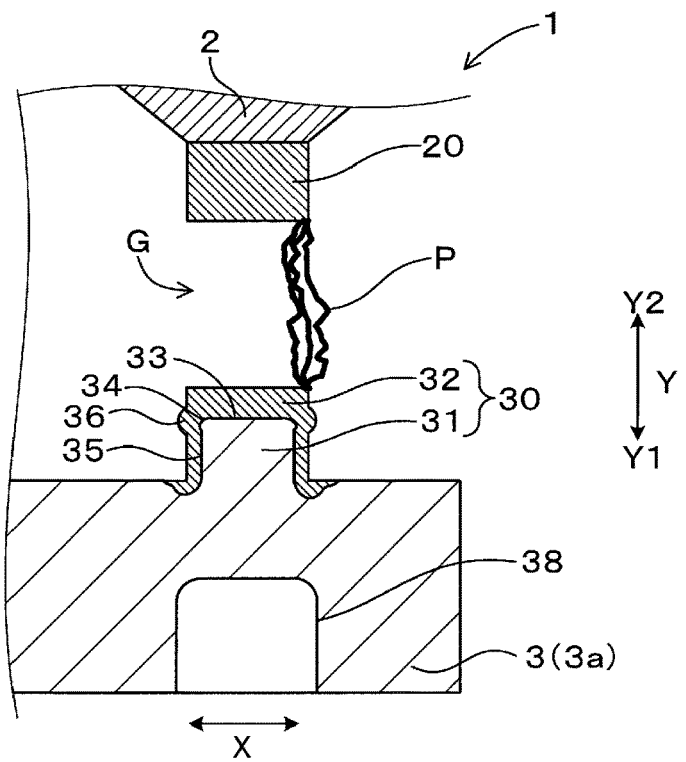
FIG. 6 is a schematic diagram illustrating the development state of a spark discharge in the first embodiment.

The use mode of the ignition plug 1 in the present embodiment will be described with reference to FIGS. 6 and 7.

The ignition plug 1 in the present embodiment is attached to an internal combustion engine not illustrated. The internal combustion engine is a lean-combustion engine. When a high voltage is applied to the center electrode at a predetermined timing, a spark discharge P is generated in the discharge gap G between the electrode protrusion 20 of the center electrode 2 and the electrode protrusion 30 of the ground electrode 3 as illustrated in FIG. 6.

Figure 7:
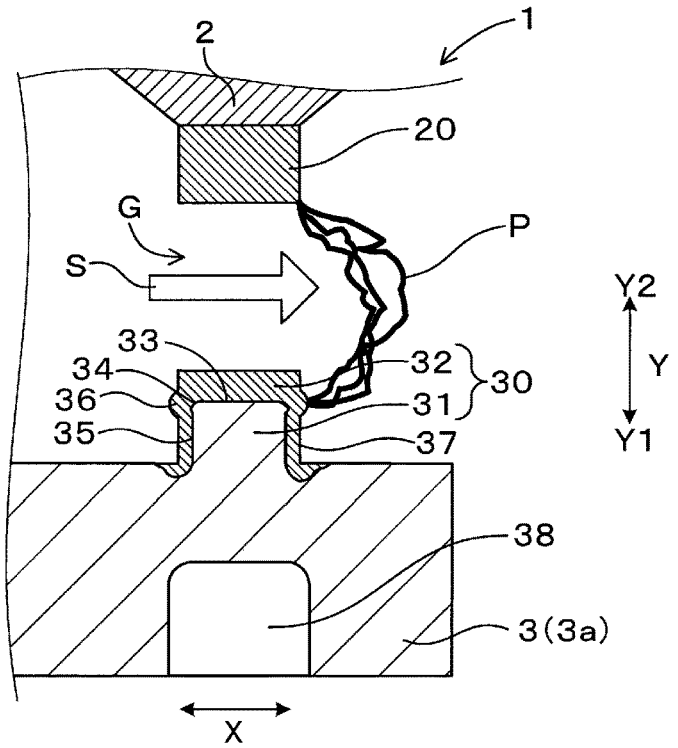
FIG. 7 is a schematic diagram illustrating the development state of a spark discharge in the first embodiment.

An airflow S of air-fuel mixture in the cylinder causes the spark discharge P to flow in the traveling direction of the airflow S as illustrated in FIG. 7. In the electrode protrusion 30 of the ground electrode 3, the spark discharge P concentrates on the projection 36. This suppresses the spark discharge P from flowing toward the electrode base material 3*a* side of the ground electrode 3.

Next, a method for manufacturing the ignition plug 1 in the present embodiment will be described with reference to FIGS. 8(*a*) to 8(*d*).

Figure 8:
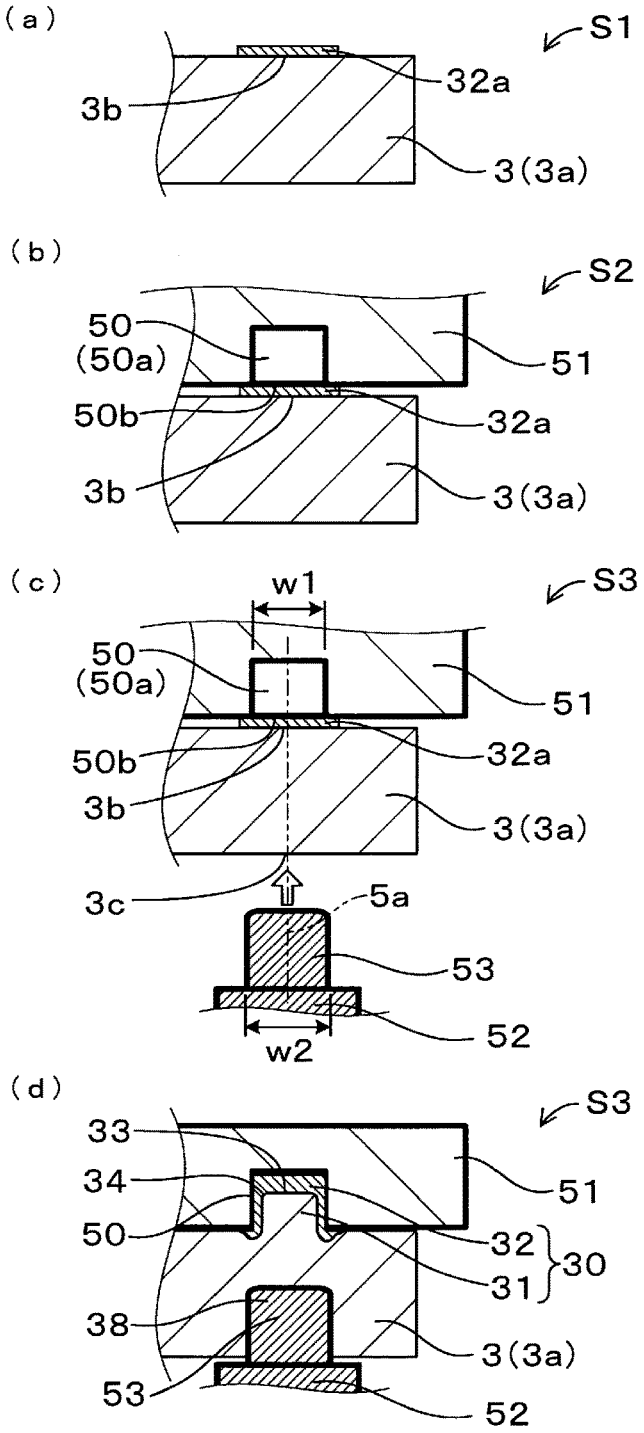
FIG. 8 is a schematic diagram illustrating the process of manufacturing the ignition plug in the first embodiment.

The method for manufacturing the ignition plug 1 includes a joint step S1, a preparation step S2, and an extrusion step S3 as illustrated in FIGS. 8(*a*) to 8(*d*).

In the joint step S1, as illustrated in FIG. 8(*a*), a cover part raw material 32*a* is joined to the electrode base material 3*a* of the ground electrode 3 by resistance welding. In the present embodiment, the cover part raw material 32*a* is formed from platinum as a precious metal having a lower linear expansion coefficient than that of Inconel 600 ("Inconel" is a registered trademark) of Special Metals Corporation, which is the material for forming the electrode base material 3*a*.

Next, in the preparation step S2, as illustrated in FIG. 8(*b*), a first jig 51 with a concave portion 50 is set along the cover part raw material 32*a* joined to the electrode base material 3*a* to form a space 50*a* between the cover part raw material 32*a* and the concave portion 50.

Then, in the extrusion step S3, as illustrated in FIGS. 8(*c*) and 8(*d*), a second jig 52 with a convex portion 53 larger than an opening 50*b* of the concave portion 50 is pressed toward the concave portion 50 against a portion 3*c* of the ground electrode 3 opposite to a portion 3*b* joined to the cover part raw material 32*a*. Accordingly, the raw material joint portion 3*b* is extruded to the space 50*a* to form the convex base part 31 and the cover part 32 in which the cover part raw material 32*a* covers at least a part of the side peripheral surface 35 and the end surface 33 in the protrusion direction of the base part 31, thereby forming the electrode protrusion 30. The ground electrode 3 has the concave portion 38 along the outer shape of the convex portion 53 of the second jig 52 on a side opposite to the electrode protrusion 30.

As illustrated in FIGS. 8(*c*) and 8(*d*), the convex portion 53 of the second jig 52 is larger than the opening 50*b* in the concave portion 50 of the first jig 51. Therefore, when the electrode base material 3*a* is pressed by the convex portion 53 into the concave portion 50 to form the base part 31, the outer edge 34 of the end surface 33 of the base part 31 is formed as a curved surface. In the present embodiment, the concave portion 50 is columnar in shape and the convex portion 53 is substantially columnar in shape. As illustrated in FIG. 8(*c*), the convex portion 53 has a diameter w2 larger than an opening diameter w1 of the opening 50*b* in the concave portion 50.

Further, in the present embodiment, as illustrated in FIG. 8(*b*), the first jig 51 is set along the cover part raw material 32*a* to cover the opening portion 50*b* in the concave portion 50 of the first jig 51 in the preparation step S2.

(Evaluation Tests)

Evaluation test 1 and evaluation test 2 of the ignition plug 1 in the embodiment were conducted as described below.

First, at the evaluation test 1, the ignition plug 1 in the above embodiment was evaluated for the presence or absence of cracks in the projection 36 with changes in the curvature radius R of the outer edge 34 and the height H of the projection 36.

Test examples 1 to 3 for the evaluation test 1 were configured as described below. That is, the test example 1 was the ignition plug 1 in the embodiment with a difference $\alpha$ in linear expansion coefficient of $3.3\times10^{-6}$/K between the base part 31 and the cover part 32, the test example 2 was the ignition plug 1 in the embodiment with a difference $\alpha$ of $3.8\times10^{-6}$/K, and the test example 3 was the ignition plug 1 in the embodiment with a difference $\alpha$ of $4.5\times10^{-6}$/K.

Figure 9:
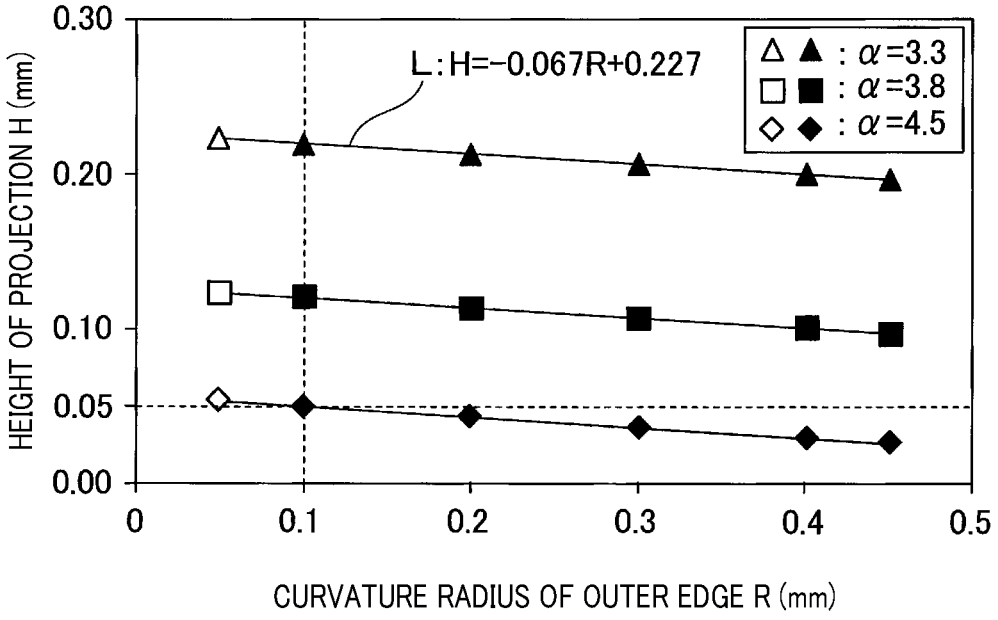
FIG. 9 is a diagram illustrating results of evaluation test 1.

As test conditions, in one cycle, the ignition plugs of the test examples 1 to 3 were set in a temperature-controllable cooling/heating bench, heated with a temperature increase from ambient temperature to 900° C., and then cooled to the ambient temperature again. The test examples 1 to 3 were subjected to 200 cycles. During the execution of 200 cycles, the test example without cracks was evaluated as good (○) and the test example with cracks in the projection 36 was evaluated as poor (x). Table 1 below indicates the test results and FIG. 9 illustrates the test results in graph form.

TABLE 1

| | Difference in linear expansion coefficient $\alpha$ (10−6/K) | Curvature radius of outer edge R (mm) | Height of projection H (mm) | Evaluation result (with cracks: x) (without cracks: ○) |
|---|---|---|---|---|
| Test example 1 | 3.3 | 0.05 | 0.054 | x |
| | | 0.10 | 0.050 | ○ |
| | | 0.20 | 0.043 | ○ |
| | | 0.30 | 0.036 | ○ |
| | | 0.40 | 0.030 | ○ |
| | | 0.45 | 0.026 | ○ |

TABLE 1-continued

| | Difference in linear expansion coefficient α (10−6/K) | Curvature radius of outer edge R (mm) | Height of projection H (mm) | Evaluation result (with cracks: x) (without cracks: ○) |
|---|---|---|---|---|
| Test example 2 | 3.8 | 0.05 | 0.054 | x |
| | | 0.10 | 0.050 | ○ |
| | | 0.20 | 0.043 | ○ |
| | | 0.30 | 0.036 | ○ |
| | | 0.40 | 0.030 | ○ |
| | | 0.45 | 0.026 | ○ |
| Test example 3 | 4.5 | 0.05 | 0.054 | x |
| | | 0.10 | 0.050 | ○ |
| | | 0.20 | 0.043 | ○ |
| | | 0.30 | 0.036 | ○ |
| | | 0.40 | 0.030 | ○ |
| | | 0.45 | 0.026 | ○ |

At the evaluation test 1, all the test examples 1 to 3 had cracks in the projection 36 and were rated as poor (x) when the curvature radius R of the outer edge 34 was 0.05 mm, whereas all the test examples 1 to 3 had no cracks in the projection 36 and were rated as good (○) when the curvature radius R of the outer edge 34 fallen within a range of 0.1 to 0.45 mm.

Referring to FIG. 9, the test example 3 with the expansion coefficient difference α of $4.5\times10^{-6}$/K had an approximate straight line L expressed as $H=-0.067R+0.227$. According to the evaluation result 1, it has been revealed that the good ignition plug 1 can be obtained with no cracks in the projection 36 when $0.1\leq R$ and $H\leq-0.067R+0.227$.

Next, the evaluation test 2 was conducted to evaluate a relationship between the height of the projection 36 and ignition performance.

First, test examples were prepared according to the configuration of the first embodiment in which the height H of the heated and cooled projection 36 was set to 0.03 mm, 0.05 mm, 0.1 mm, 0.2 mm, 0.3 mm, 0.4 mm, and 0.5 mm. In addition, a comparative example with the height H of the projection 36 of 0 mm, that is, without the projection 36, was prepared.

Figure 10:
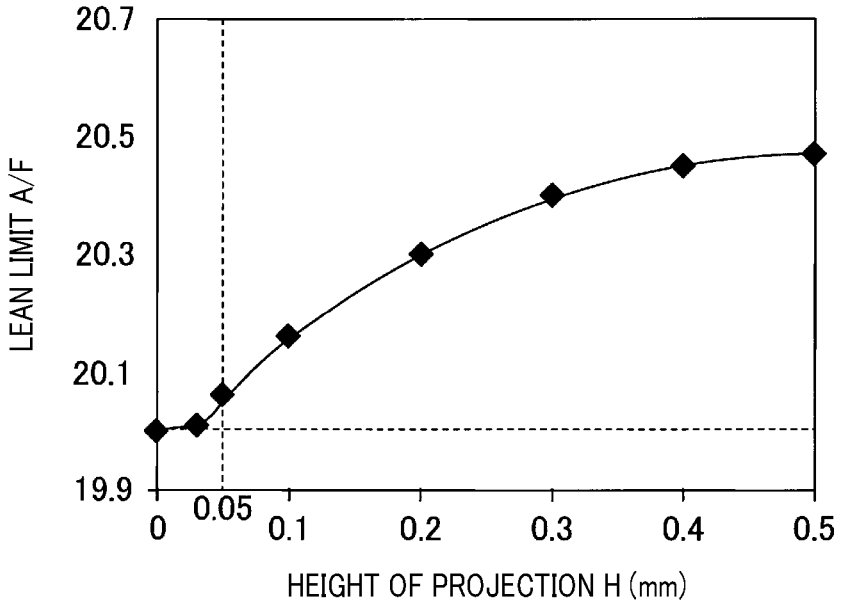
FIG. 10 is a diagram illustrating results of evaluation test 2.

As test conditions, each of the ignition plugs of the test examples and the comparative example was attached to a four-cylinder internal combustion engine with a displacement of 1800 cc, and the internal combustion engine was driven at 2000 rpm and under a Pmi of 0.28 MPa, where the A/F with a Pmi variation rate of 3% or more was set as lean limit A/F. FIG. 10 is a graph in which the height H of the projection 36 and the lean limit A/F at the evaluation test 2 are plotted.

According to the evaluation test 2, as illustrated in FIG. 10, the test example with the height H of the projection 36 of 0.03 mm had only a slight increase in the lean limit A/F and had no improvement in ignition performance, as compared to the comparative example with the height H of the projection 36 of 0 mm. On the other hand, the test examples with the height H of the projection 36 of 0.05 mm or more had sufficient increases in the lean limit A/F, and had improvement in ignition performance, as compared to the comparative example with the height H of the projection 36 of 0 mm.

Accordingly, the evaluation tests 1 and 2 have revealed that satisfying $3.3\times10^{-6}/K\leq\alpha\leq4.5\times10^{-6}/K$ would ensure the difference α in linear expansion coefficient between the material for forming the cover part 32 and the material for forming the base part 31 to form the projection 36 in a reliable manner by heating and cooling.

Further, the test results have shown that ignition performance would be further improved by the curvature radius R of the outer edge 34 of the end surface 33 of the base part 31 satisfying $0.1\ mm\leq R$. Moreover, the test results have revealed that ignition performance would be reliably improved by the curvature radius R of the outer edge 34 satisfying $0.1\ mm\leq R\leq0.45\ mm$.

In addition, the test results have demonstrated that the projection 36 would have no cracks but ignition performance would be improved by the height H of the projection 36 and the curvature radius R of the outer edge 34 of the end surface 33 satisfying $0.05\ mm\leq H\leq-0.067R+0.227\ mm$.

Next, the operations and effects of the ignition plug 1 for the internal combustion engine in the present embodiment will be described in detail.

In the ignition plug 1 for the internal combustion engine of the present embodiment, the portion of the electrode protrusion 30 facing the discharge gap G has the cover part 32 formed from a precious metal or a precious metal alloy, and thus the electrode protrusion 30 has less wear caused by a spark discharge to achieve a longer lifetime of the ignition plug 1. Further, the material for forming the base part 31 of the electrode protrusion 30 can be a material less expensive than that for the cover part 32. This reduces manufacturing cost as compared to the case of forming the entire electrode protrusion 30 from the material for forming the cover part 32.

In addition, the precious metal or the precious metal alloy for forming the cover part 32 has lower linear expansion coefficient than that of the material for forming the base part 31, and thus there occurs the difference α in linear expansion coefficient between the two parts. However, the outer edge 34 of the end surface 33 of the base part 31 has a curved surface in the protrusion direction that makes it less likely to form corners in the joint portion between the base part 31 and the cover part 32 covering the base part 31. This suppresses excessive concentration of thermal stress from occurring resulting from the difference α in linear expansion coefficient. As a result, the occurrence of cracks due to thermal stress is suppressed from occurring in the joint portion between the base part 31 and the cover part 32 to achieve a longer lifetime of the ignition plug 1 from this viewpoint as well.

Further, when the ignition plug 1 is attached to an internal combustion engine and the electrode protrusion 30 is heated and cooled in a cylinder, the portion 37 of the cover part 32 covering the side peripheral surface 35 of the base part 31 is formed with the projection 36. Accordingly, in a lean-combustion engine with a fast airflow in a cylinder, even when the spark discharge P generated in the discharge gap G starts to move to the base part 31 side due to the high-velocity airflow, the spark discharge P is likely to concentrate on the projection 36 of the portion 37 covering the side peripheral surface 35 of the base part 31, which prevents the discharge path from becoming lengthen excessively. This suppresses the spark discharge P from being blown-off. As a result, the ignition performance is improved. The projection 36 is formed resulting from the difference $\alpha$ in linear expansion coefficient between the materials for forming the base part 31 and the cover part 32.

In addition, in the ignition plug 1 of the present embodiment, the material for forming the base part 31 is a nickel alloy, and the material for forming the base part 31 is platinum. Accordingly, the difference $\alpha$ in expansion coefficient between the two parts satisfies $3.3\times10^{-6}/K\leq\alpha\leq4.5\times10^{-6}/K$ described above. As a result, the difference $\alpha$ in linear expansion coefficient is ensured to form the projection 36 in a reliable manner by heating and cooling.

Next, the operations and effects of the manufacturing method in the present embodiment will be described in detail.

According to the method for manufacturing the ignition plug 1 for the internal combustion engine of the present embodiment, the cover part raw material 32*a* is joined to the electrode base material 3*a* by resistance welding in the joint step S1. Accordingly, the cover part raw material 32*a* and the electrode base material 3*a* do not have an intermediate layer therebetween that would be formed by melt-mixing the two materials in a case of using laser welding or electronic beam welding, but has an interface therebetween. Therefore, when the ignition plug 1 is attached to the internal combustion engine and the electrode protrusion 30 is heated and cooled in the cylinder, the ignition plug 1 has the projection 36 formed in a reliable manner in the presence of the difference $\alpha$ in linear expansion coefficient between the materials for forming the two parts. This facilitates the manufacture of the ignition plug 1 in the embodiment.

In addition, according to the embodiment, the first jig 51 is set along the cover part raw material 32*a* such that the cover part raw material 32*a* covers the opening 50*b* in the concave portion 50 of the first jig 51 in the preparation step S2. Accordingly, the cover part 32 formed from the cover part raw material 32*a* covers entirely the end surface 33 and the side peripheral surface 35 of the base part 31. This makes it possible to further suppress wear on the electrode protrusion 30 from occurring caused by a spark discharge.

Figure 11:
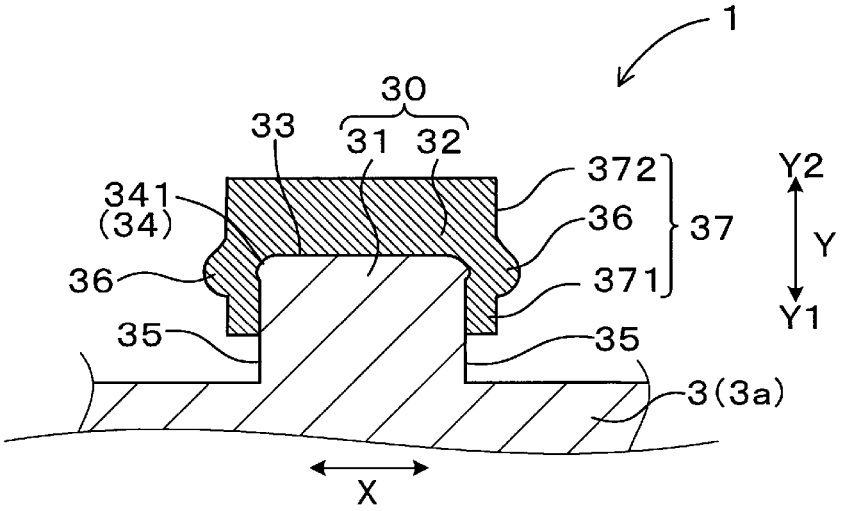
FIG. 11 is a partially enlarged cross-sectional view of a discharge gap and its vicinity in a first modification.

According to the present embodiment, as illustrated in FIGS. 4(*a*) to 4(*c*), the cover part 32 covers the end surface 33 and the side peripheral surface 35 of the base part 31 entirely. Instead of this, the cover part 32 may be configured as in a first modification illustrated in FIG. 11 as far as the effect of suppressing wear on the electrode protrusion 30 from occurring can be obtained. In the first modification, as illustrated in FIG. 11, the projection 36 is formed along the entire perimeter of the cover part 32 but the cover part 32 may not cover some part of the side peripheral surface 35 of the base part 31. In such a case, operations and effects equivalent to those of the present embodiment can be obtained.

As described above, according to the present embodiment, it is possible to provide the ignition plug 1 for the internal combustion engine that achieves a longer lifetime and improved ignition performance, and a method for manufacturing the same.

Although the present disclosure has been described so far according to the present embodiment, it is noted that the present disclosure is not limited to the foregoing embodiment or structure. The present disclosure includes various modifications and changes in a range of equivalency. In addition, various combinations and modes, and other combinations and modes including only one element of the foregoing combinations and modes, less or more than the one element fall within the scope and conceptual range of the present disclosure.

What is claimed is:

1. An ignition plug for an internal combustion engine comprising:

a center electrode;

a ground electrode that is disposed opposing the center electrode to form a discharge gap between the center electrode and the ground electrode; and an electrode protrusion that protrudes from an electrode base material of the ground electrode toward the discharge gap, wherein the electrode protrusion has a base part that is integrated with the electrode base material and a cover part that is joined to the base part and faces the discharge gap, the base part has an end surface facing a protrusion direction of the base part and a side peripheral surface that leads from an outer edge of the end surface to the electrode base material, the outer edge of the end surface forming a curved surface, the cover part is formed from a precious metal or a precious metal alloy having a lower linear expansion coefficient than that of a material for forming the base part and covers at least a part of the side peripheral surface and the end surface, and when the ignition plug is attached to an internal combustion engine and the electrode protrusion is heated and then cooled in a cylinder, a projection is formed on an outer surface of a portion of the cover part covering the side peripheral surface of the base part.

2. The ignition plug for an internal combustion engine according to claim 1, wherein a difference $\alpha$ in linear expansion coefficient between the material for forming the cover part and the material for forming the base part satisfies $3.3\times10^{-6}/K\leq\alpha\leq4.5\times10^{-6}/K$.

3. The ignition plug for an internal combustion engine according to claim 1, wherein a curvature radius R of the outer edge of the end surface satisfies $0.1\ mm\leq R$.

4. The ignition plug for an internal combustion engine according to claim 1, wherein the curvature radius R of the outer edge of the end surface satisfies $0.1\ mm\leq R\leq0.45\ mm$.

5. The ignition plug for an internal combustion engine according to claim 1, wherein a height H of the projection and the curvature radius R of the outer edge of the end surface satisfy $0.05\ mm\leq H\leq-0.067R+0.227\ mm$.

6. The ignition plug for an internal combustion engine according to claim 1, wherein the material for forming the base part is nickel or a nickel alloy, and the material for forming the cover part is platinum, a platinum alloy, iridium, an iridium alloy, or a platinum-iridium alloy.

7. A method for manufacturing the ignition plug for the internal combustion engine according to claim 1, wherein the method comprises:

a joint step of joining a cover part raw material formed from a precious metal or a precious metal alloy lower in linear expansion coefficient than a material for forming the electrode base material to the electrode base material by resistance welding;

a preparation step of setting a first jig with a concave portion along the cover part raw material joined to the electrode base material to form a space between the cover part raw material and the concave portion; and an extrusion step of pressing a second jig with a convex portion larger than an opening in the concave portion against the concave portion at a portion of the electrode base material on the side opposite to a raw material joint part joined to the cover part raw material to extrude the raw material joint part into the space and form a convex base part and forming a cover part in which the cover part raw material covers at least a part of a side peripheral surface and an end surface facing the protrusion direction of the base part, thereby forming the electrode protrusion.

8. The method for manufacturing the ignition plug for the internal combustion engine according to claim 7, wherein the first jig is set along the cover part raw material such that the cover part raw material covers the opening in the preparation step.

* * * * *